US008030585B2

(12) United States Patent
Wang

(10) Patent No.: US 8,030,585 B2
(45) Date of Patent: Oct. 4, 2011

(54) PRESS-KEY STRUCTURE

(75) Inventor: Yi-Chen Wang, Tainan County (TW)

(73) Assignee: Darfon Electronics Corp., Taoyuan (TW)

( * ) Notice: Subject to any disclaimer, the term of this patent is extended or adjusted under 35 U.S.C. 154(b) by 563 days.

(21) Appl. No.: 12/171,434

(22) Filed: Jul. 11, 2008

(65) Prior Publication Data

US 2009/0038922 A1 Feb. 12, 2009

(30) Foreign Application Priority Data

Aug. 7, 2007 (TW) ..... 96128954 A

(51) Int. Cl.
*H01H 13/70* (2006.01)

(52) U.S. Cl. ..... 200/344; 200/5 A

(58) Field of Classification Search ..... 400/490–495; 200/5 A, 512–517, 341–345
See application file for complete search history.

(56) References Cited

U.S. PATENT DOCUMENTS 6,730,868 B1 * 5/2004 Watanabe ..... 200/344
6,759,614 B2 * 7/2004 Yoneyama ..... 200/344

* cited by examiner

*Primary Examiner* — Renee Luebke
*Assistant Examiner* — Marina Fishman
(74) *Attorney, Agent, or Firm* — WPAT, PC; Justin King

(57) ABSTRACT

A press-key structure is disclosed, which comprises: a keycap, configured with a bottom surface; a substrate, being disposed under the keycap; and a pressing part, being arranged between the keycap and the substrate. In an exemplary embodiment, the pressing part further comprising: a frame, disposed on the bottom surface to be used for sustaining a pressing force from the keycap directly; and a plurality of supporting legs, being arranged surrounding the edges of the frame while extending outwardly from the same; wherein by connecting the outward-extending ends of the plural supporting legs to the substrate, the frame is supported and propped up by a specific height.

17 Claims, 9 Drawing Sheets

PRESS-KEY STRUCTURE

FIELD OF THE INVENTION

The present invention relates to a press-key structure, and more particularly, to a press-key structure designed with a keycap capable of being assembled directly in a vertical stacking manner, by that not only the height of the keycap is reduced, but also the overall structure complexity of the press-key is decreased.

BACKGROUND OF THE INVENTION

In response to the needs for lighter, thinner and smaller products, the notebook computer manufacturers especially have to improve their designs continuously just to catch up with the trend. However, the quest for even thinner notebook computers should not take the elastic touching feeling of its press-keys as sacrifice just for the sake of achieving a thinner keyboard. Conventionally, a press-key is usually constructed with a scissors-type elastic structure, as shown in FIG. 1 and FIG. 2. The aforesaid press-key 10 is comprised of: a keycap 14, a substrate 13 and two supporting arms 11, 12 sandwiched between the keycap 13 and the substrate 14. In FIG. 1, the two supporting arms 11, 12 are pivotally coupled with each other at the middle thereof forming an X-shaped structure. It is noted that the aforesaid conventional press-key 10 is assembled by the procedures described as following: the first step is to inset the pivotal axes 112, 122 of the two supporting arms 11, 12 respectively into the joints 131, 132 formed on the substrate 13 so that the two supporting arms 11, 13 are connected with the substrate 13 and thus the press-key 10 is semi-finished; and then by connecting the keycap 14 to the tops of the two supporting arms 11, 12, the press-key 10 is completed.

As shown in FIG. 1, there are a coupling structure 141 with lateral engagement opening and another coupling structure 142 with vertical engagement opening that both are formed on the bottom of the keycap 14. Thus, when it comes to the assembling of the keycap 14, first the keycap 14 must be tilted by a specific angle for enabling the first pivotal axis 111 formed on the top of the supporting arm 11 to be inset into the lateral engagement opening of the coupling structure 141; and then the keycap 14 is pressed downwardly for engaging the vertical engagement opening coupling structure 142 with the second pivotal axis 121 formed on the top of another supporting arm 12, as shown in FIG. 2.

As the aforesaid conventional press-key 10 is so-structured, it must be assembled manually so that it is disadvantageous in that: not only its production efficiency as well as its yield are poor, but also the keycap is very easy to be damaged during the manual insetting the two engagement openings with the tops of their corresponding supporting. Moreover, as the two supporting arms 11, 12 are pivotally coupled with each other at the middle thereof forming an X-shaped structure, the keycap 14 must be elevated by a specific height that has no way to be reduced.

SUMMARY OF THE INVENTION

In view of the disadvantages of prior art, the object of the present invention is to provide a press-key structure, which is designed with a keycap capable of being assembled directly in a vertical stacking manner, by that not only the height of the keycap is reduced and the overall structure complexity of the press-key is decreased, but also such press-key structure can be assembled in a semi-automation manner with comparatively highly production efficiency and low defect rate.

To achieve the above object, the present invention provides a press-key structure, comprising:

- a keycap, configured with a bottom surface;
- a substrate, being disposed under the keycap; and
- a pressing part, being arranged between the keycap and the substrate, further comprising:
  - a frame, disposed on the bottom surface of the keycap to be used for directly sustaining a pressing force from the keycap; and
  - a plurality of support legs, each being connected to the edge of the frame by an end thereof while extending outwardly from the same; and thus connecting the outward-extending ends of the plural supporting legs to the substrate for supporting and propping up the frame by a specific height.

Preferably, the frame is shaped like a disc, a rectangle, or any geometry shapes.

Preferably, the plural supporting legs are arranged equidistant from each other and surrounding the edges of the frame.

Preferably, the plural supporting legs are disposed at two opposite sides of the frame in a symmetrical manner.

Preferably, there are a plurality of clipping parts being arranged on the substrate at positions corresponding to the outward-extending ends of the plural supporting legs, provided for the plural supporting legs to engage therewith so as to form connections between the substrate and the plural supporting legs.

Preferably, each clipping part is configured with a hollow portion provided for its corresponding supporting leg to inset therein.

Preferably, there are a plurality of blocking plates being disposed on the substrate at positions corresponding to the hollow portions of the plural clipping parts, provided for blocking the outward-extending ends of the plural supporting legs from moving.

Preferably, the frame and the plural supporting legs are integrally formed.

Preferably, the frame and the plural supporting legs are formed separately while forming coupling members at positions between the frame and the plural supporting legs to be used for connecting the substrate with the plural supporting legs.

Preferably, each coupling member comprises:

- an upward-bulging flange, formed on the top circumference of the frame in a manner that it is configured with a plurality of recesses at positions corresponding to the plural supporting legs to be provided for the corresponding supporting legs to fit therein; and
- a plurality of stoppers, each being formed on the end of its corresponding supporting leg facing toward the frame and each being configured with a width larger than that of its corresponding supporting leg;
- wherein, the stoppers are abutted against the inner side of the flange when the supporting legs are inset into their corresponding recesses on the top circumference of the frame.

Preferably, the frame is made of a material selected from the group consisting a metal, a plastic and the combination thereof.

Preferably, each of the plural supporting legs is made of a material selected from the group consisting a metal, a plastic and the combination thereof.

Preferably, there is a coupling member formed between the pressing part and the keycap to be used for connecting the two.

Preferably, the coupling member is composed of at least a hook and at least a hook catch.

Preferably, there is more than one such hook being disposed on the bottom surface of the keycap, while there is more than one such hook catches being disposed at positions corresponding to the plural hooks on the frame of the pressing part.

Preferably, there is an orientation member formed between the pressing part and the keycap, and the orientation member is comprised of: at least a protruding element; and at least a concave element, provided for the at least one protruding element to inset therein.

Preferably, the at least one protruding element is disposed on the bottom surface of the keycap while arranging the at least one concave element to be disposed at a position corresponding to the at least one protruding element on the frame of the pressing part.

Preferably, the at least one protruding element is disposed on the bottom surface of the keycap at the center thereof while arranging the at least one concave element to be disposed at a position corresponding to the at least one protruding element at the center of the frame.

Preferably, the concave element can be formed as a hole or a recess.

Preferably, the protruding element is a column while the concave element is round-shaped recess for the column to be embedded therein.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
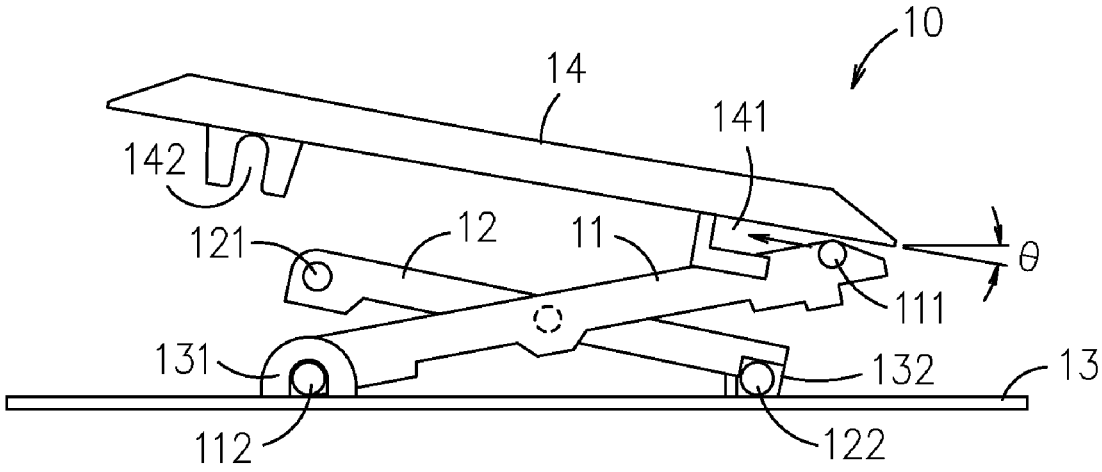
FIG.1 (Prior Art)
FIG. 1 and FIG. 2 are schematic diagrams showing a conventional press-key constructed with a scissors-type elastic structure.
Figure 2:
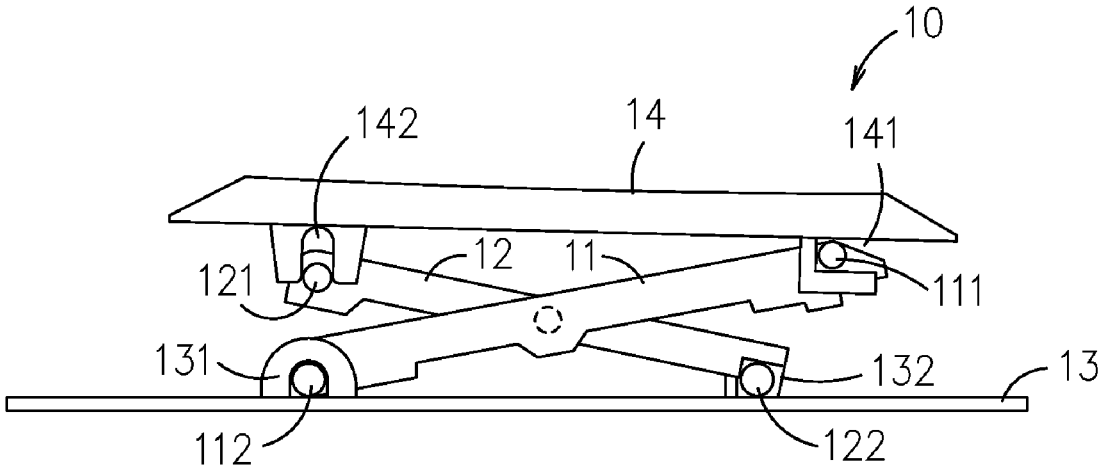
FIG.2 (Prior Art)
Figure 3:
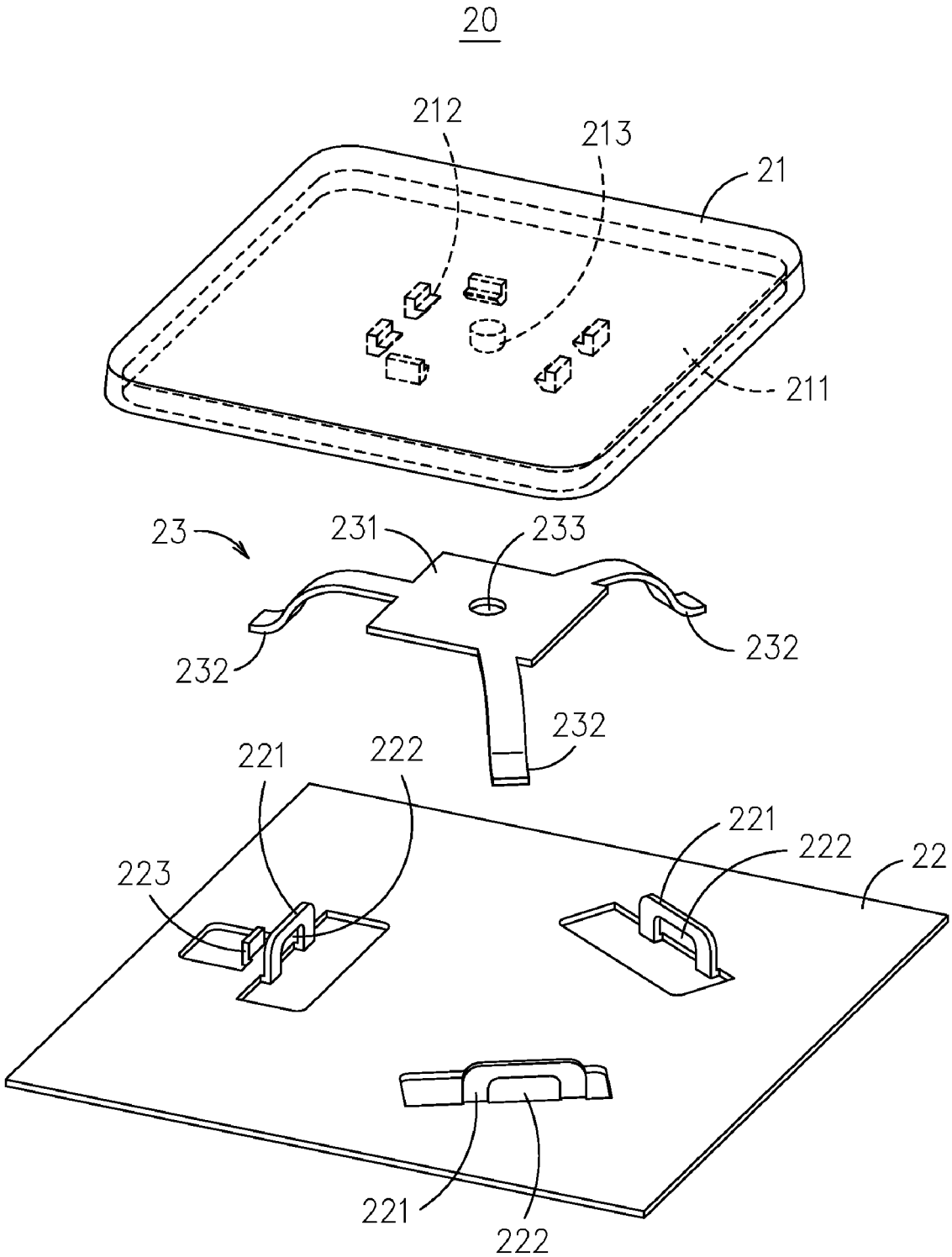
FIG. 3 is an exploded view of a press-key structure according to a first embodiment of the invention.
Figure 4:
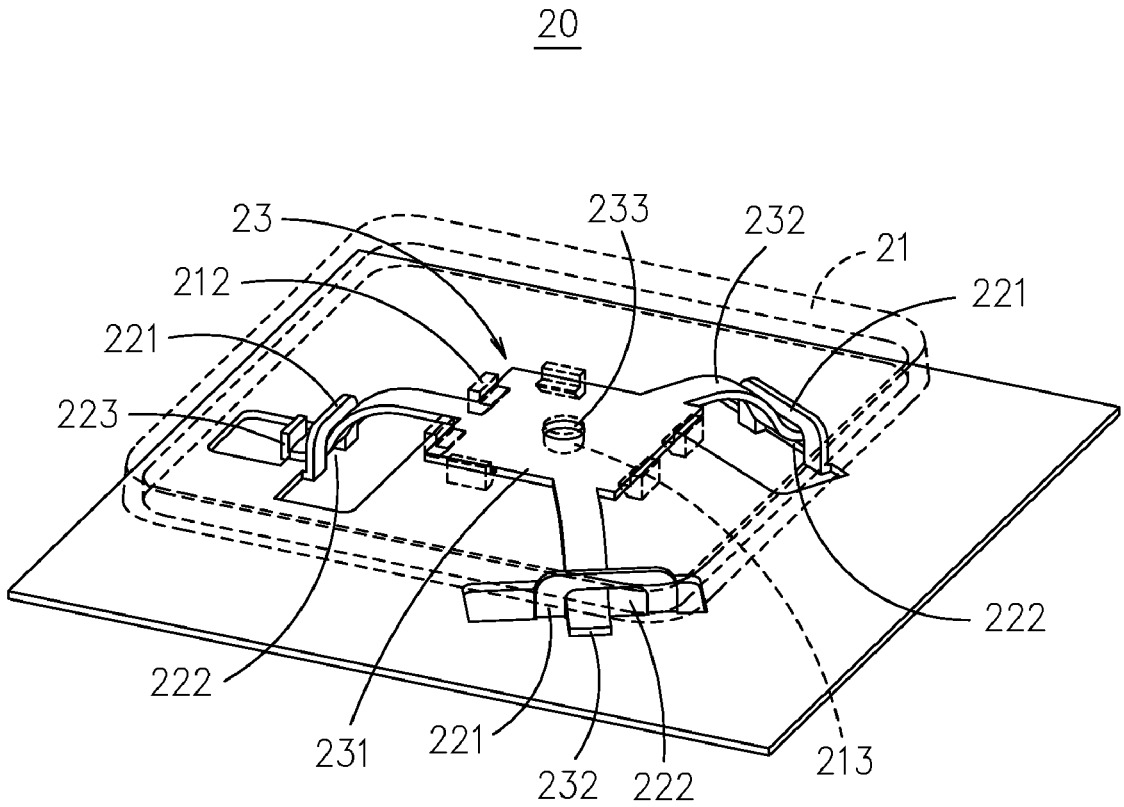
FIG. 4 is a three-dimensional view of a press-key structure according to the first embodiment of the invention.

Please refer to FIG. 3 and FIG. 4, which show a press-key structure according to a first embodiment of the invention. The press-key structure comprises: a keycap 21, a substrate 22 and a pressing part 23, in which the keycap 21 is configured with a bottom surface 211; the substrate 22 is disposed under the keycap 21 while arranging the pressing part 23 between the keycap 21 and the substrate 22. In an exemplary embodiment, the pressing part 23 is further comprised of: a frame 231 and a plurality of supporting legs 232, in which the frame 231 is disposed on the bottom surface 211 of the keycap 21; and the plural supporting legs 232 are connected to the circumference of the frame by an end thereof while extending outwardly from the same and thus connecting the outward-extending ends of the plural supporting legs 232 to the substrate 22.

There is no restriction relating to the shape of the frame 231, which can be formed as a disc, a rectangle or any geometrical shapes. In this embodiment, the frame 231 is shaped like a rectangle and the plural supporting legs 232 are arranged equidistant from each other and surrounding the edges of the frame 231. It is noted that both the frame 231 and the supporting legs 232 can be made of a metal, a plastic or the combination thereof. As the frame 231 and the supporting legs 232 in this embodiment are integrally formed, the formation of the frame 231 and the supporting legs 232 can be achieved by the stamping of a metal sheet.

Moreover, there can be a coupling member formed between the pressing part 23 and the keycap 21 to be used for connecting the two. As shown in FIG. 3, such coupling member includes a plurality of hooks 212, which are designed to hold on to the edge of the frame 231 and thereby connect the keycap 21 with the pressing part 23. In addition, there is an orientation member formed between the pressing part 23 and the keycap 21. In this exemplary embodiment, the orientation member is comprised of: a column 213, formed on the bottom surface 211 of the keycap; and a hole 233, formed on the frame 231, provided for the column 213 to inset and pass therethrough. By insetting the column 213 into the hole 233, the keycap 21 is orientated with respect to the pressing part 23 and thus is ready for assembly. Therefore, it is preferred to form the hole 233 right at the center of the frame 231, since such arrangement can prevent the keycap 21 from slanting as the keycap 21 is being pressed on the pressing part 23. It is noted that such orientation member is not limited by the column 213 and the hole 233, it can be composed of other kinds protruding element and concave element, and moreover, it is also not to be limited by only one pair of such protruding element and concave element, as the one shown in FIG. 3.

In addition, there are a plurality of clipping parts 221 being arranged on the substrate 22 at positions corresponding to the outward-extending ends of the plural supporting legs 232, provided for the plural supporting legs 232 to engage therewith so as to form connections between the substrate 22 and the pressing part 23. In this embodiment, each clipping part 221 is configured with a hollow portion 222, which is provided for its corresponding supporting leg 232 to inset therein. Moreover, there are a plurality of blocking plates 223 being disposed on the substrate 22 at positions corresponding to the hollow portions 222 of the plural clipping parts 221, which are provided for blocking the outward-extending ends of the plural supporting legs 232 from moving.

Figure 5:
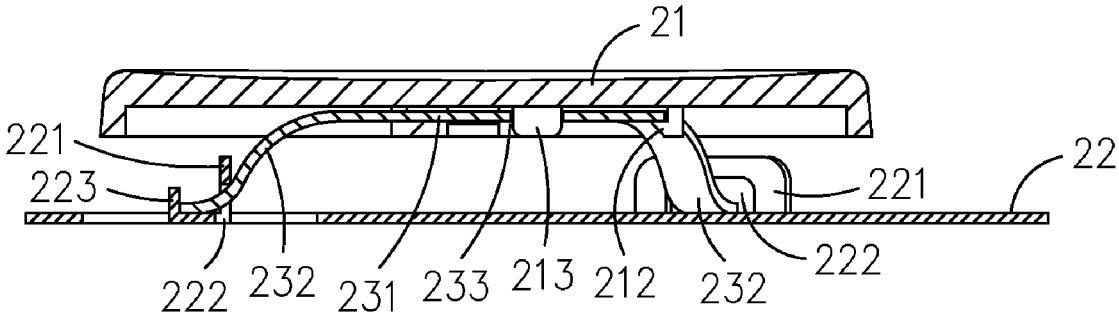
FIG. 5 is a cross sectional view of FIG. 3 as it is not being pressed.
Figure 6:
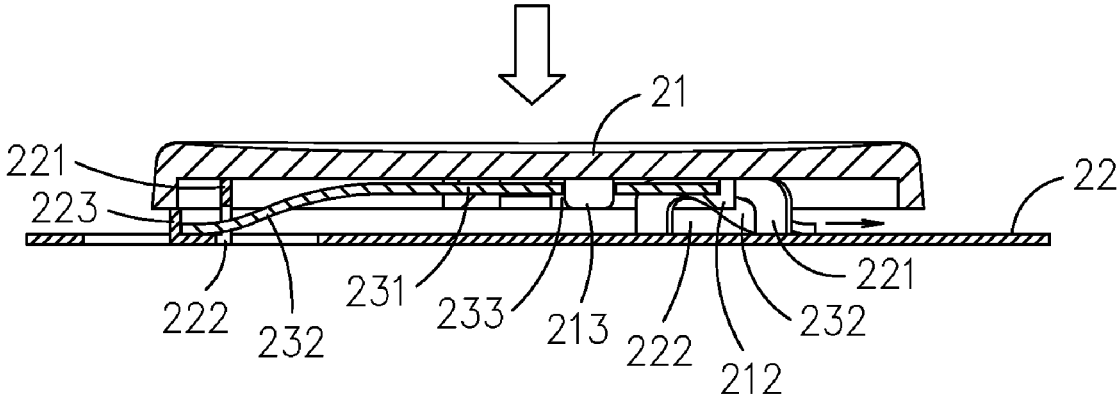
FIG. 6 is a cross sectional view of FIG. 3 as it is being pressed.

Please refer to FIG. 5 and FIG. 6, which show the statuses of a press-key structure as it is not being pressed and as it is being pressed. When the press-key structure is not being pressed as shown in FIG. 5, by the support of those arc-shaped supporting legs 232, both the frame 231 and the keycap 21 are supported and propped up by a specific height. When the press-key structure is being pressed as shown in FIG. 6, the pressing force will force the frame 231 to descend while forcing those supporting legs 231 that are not blocked by the blocking plates 223 to extrude out from the corresponding hollow portions 222; and as soon as the pressing force is removed, the resilience of the supporting legs 232 will prop up the frame 231 for raise the same back to its corresponding original height as that shown in FIG. 5. It is noted that there is no restriction relating to the amount of the blocking plate 223 being disposed in the press-key structure of the invention, only if there is at least one supporting leg 232 out of the plural supporting legs 232 is being blocked and thus restricted the same from any movement. To restrict the supporting leg 232 from any movement is to enable the deformed supporting leg 232 to accumulate elastic energy as it is being pressed, and then to be used for propping up the pressing part 23. In addition, the arranging of the blocking plate 223 in the press-key structure can prevent the pressing part 23 from wobbling as it is pressed by the keycap 21.

Figure 7:
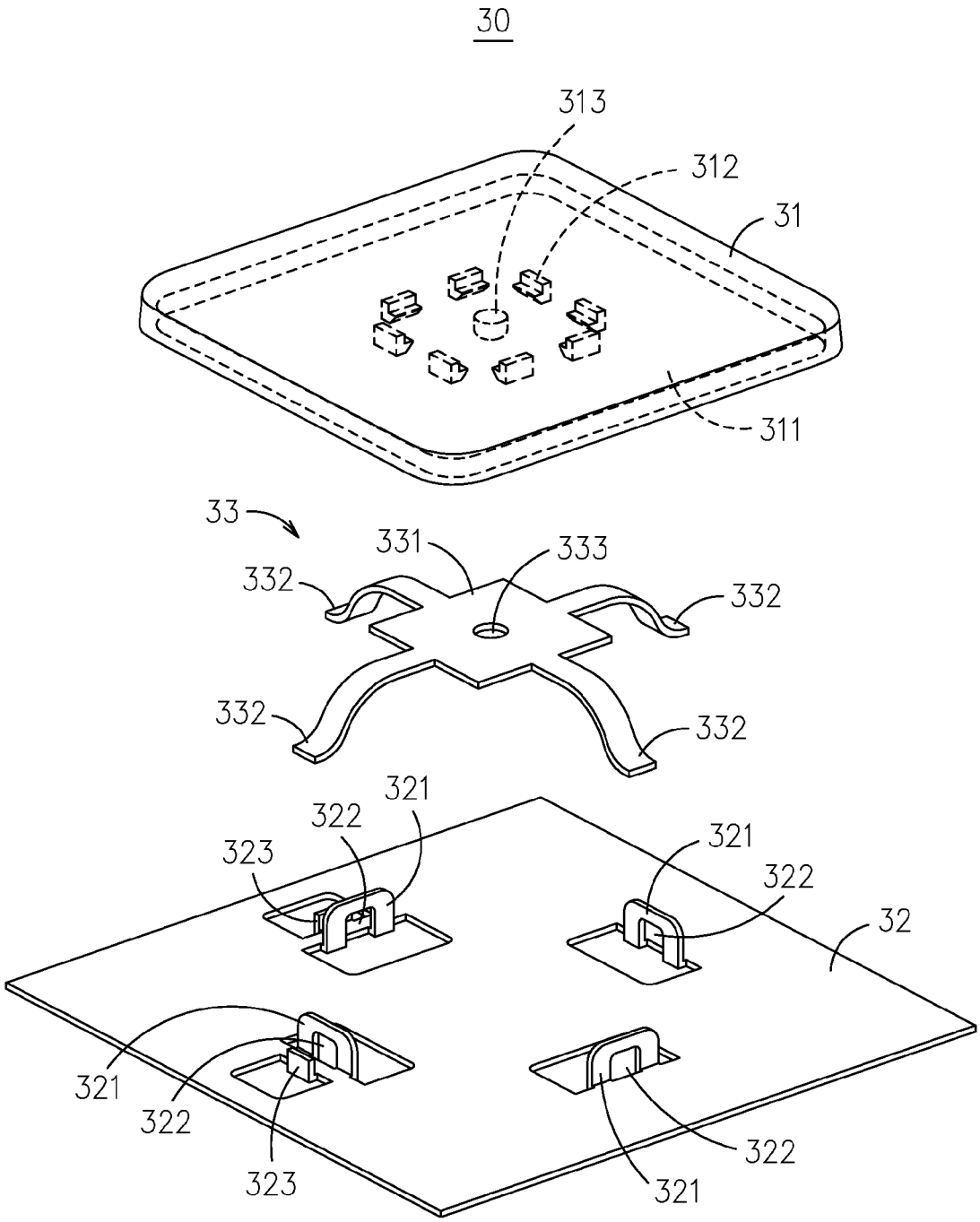
FIG. 7 is an exploded view of a press-key structure according to a second embodiment of the invention.

Please refer to FIG. 7, which is an exploded view of a press-key structure according to a second embodiment of the invention. In FIG. 7, the press-key structure 30 comprises a keycap 31, a substrate 32, and a pressing part 33. The pressing part 33 is further comprised of: a rectangle-shaped frame 331; and four supporting legs 332, arranged respectively at the four side of the frame 331. Similarly, there are a plurality of hooks 312 and a column 313 being formed on the bottom surface 311 of the keycap 31, so that the pressing part 33 and the keycap 31 can be connected and orientated by insetting the column 313 into a hole 333 formed on the frame 331 and by enabling the hooks 312 to hold on to the edges of the frame 331. Moreover, there are four clipping parts 321 formed on the substrate 32 at positions corresponding to the four supporting legs 332, and accordingly there are two blocking plates 323 being formed on the substrate 32 at positions corresponding to the hollow portions of two clipping parts 321 selected from the four clipping parts 321. It is noted that the function as well as how it works are all the same with those described in the embodiment shown in FIG. 3, and thus are not described further herein.

Figure 8:
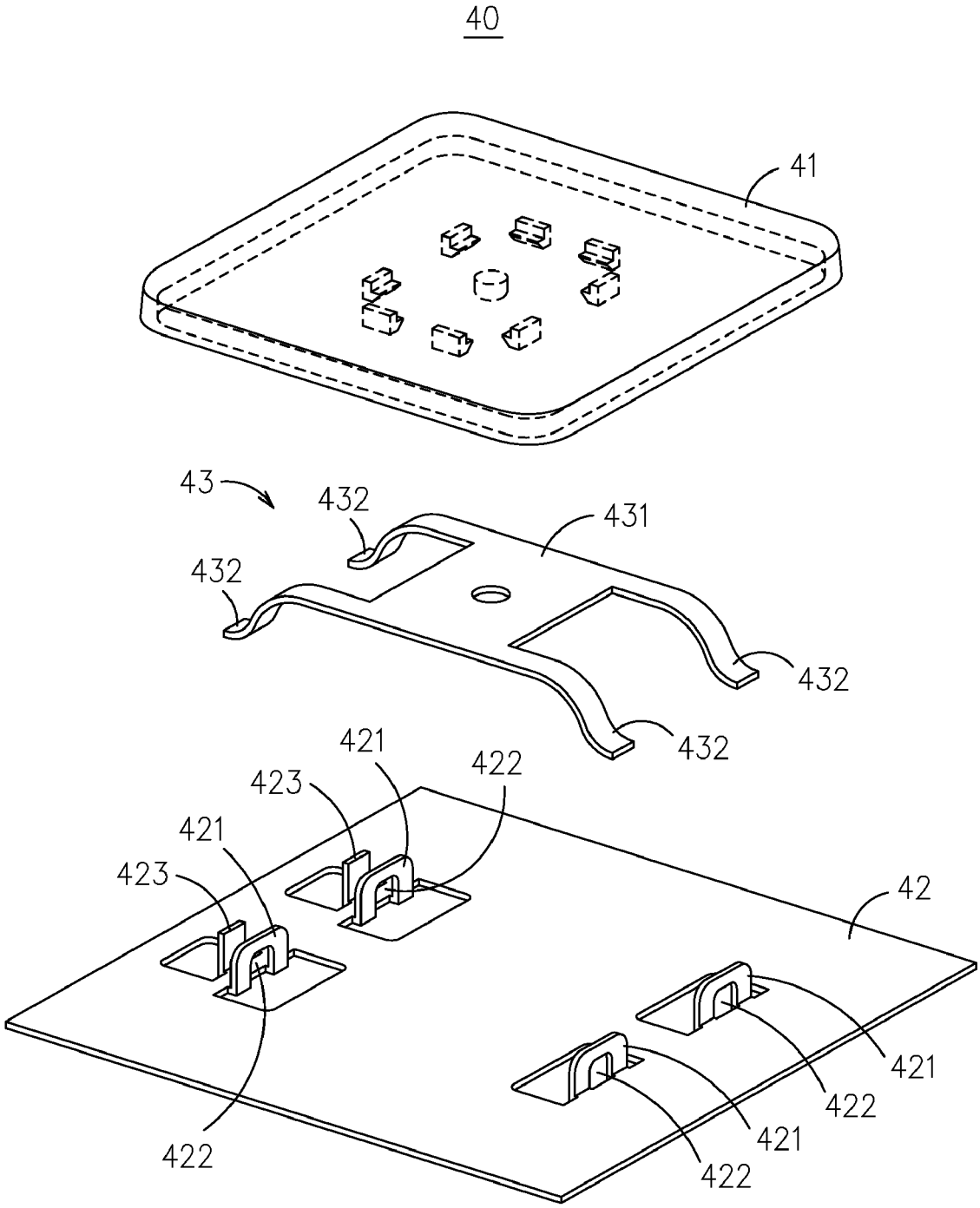
FIG. 8 is an exploded view of a press-key structure according to a third embodiment of the invention.

Please refer to FIG. 8, which is an exploded view of a press-key structure according to a third embodiment of the invention. In FIG. 8, the press-key structure 40 comprises a keycap 41, a substrate 42, and a pressing part 43. Similarly, the pressing part 43 also has four supporting legs 332, but instead of being arranged respectively at the four side of the frame 431, they are arranged at two opposite sides of the frame 431 in a symmetrical manner. Correspondingly, there are also four clipping parts 421 formed on the substrate 42 at positions corresponding to the four supporting legs 432, and accordingly there are also two blocking plates 423 being formed on the substrate 42 at positions corresponding to the hollow portions of any two neighboring clipping parts 321 arranged at the same side of the frame 431. It is noted that the function as well as how it works are all the same with those described in the embodiment shown in FIG. 3 and FIG. 7, and thus are not described further herein.

Figure 9:
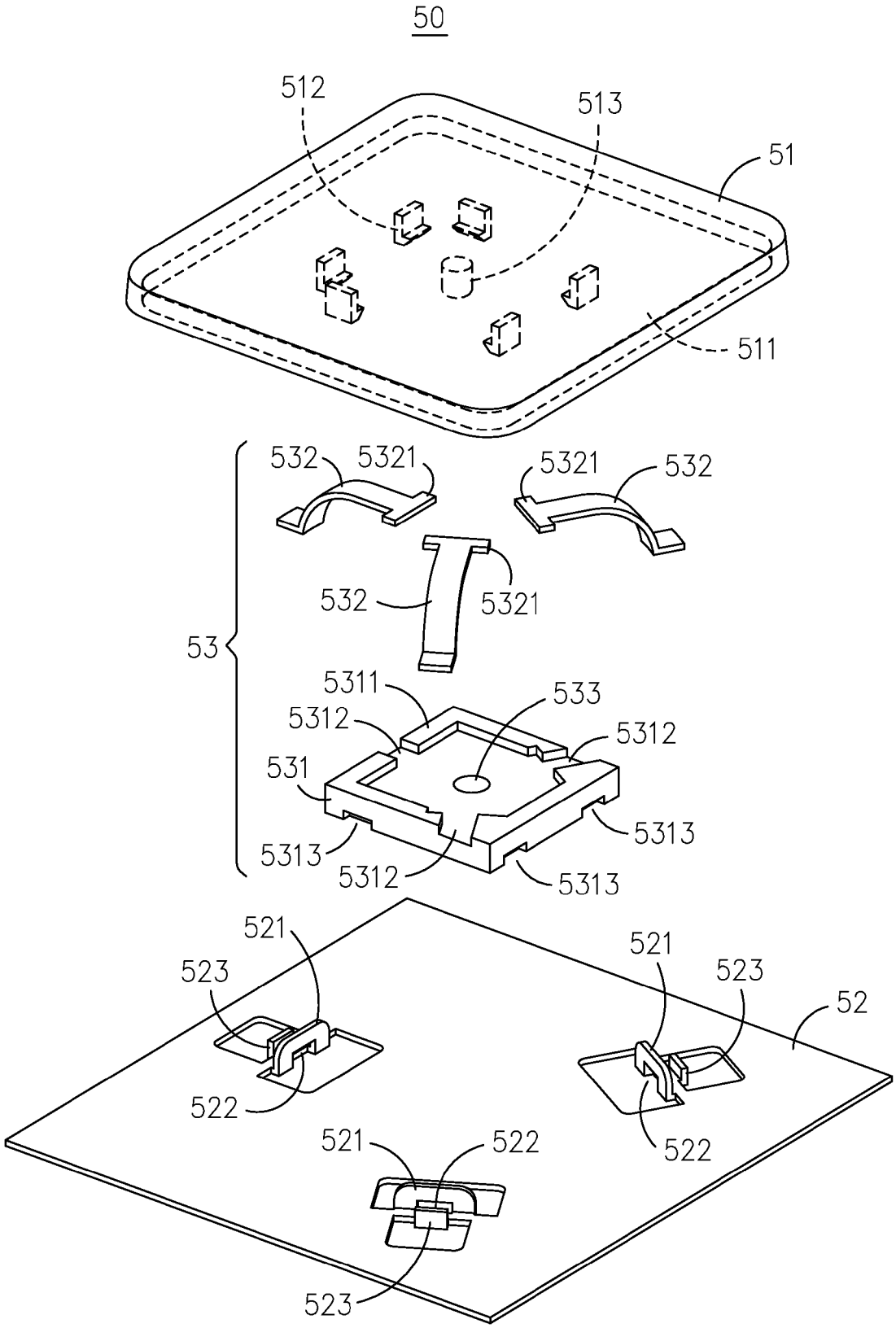
FIG. 9 is an exploded view of a press-key structure according to a fourth embodiment of the invention.
Figure 10:
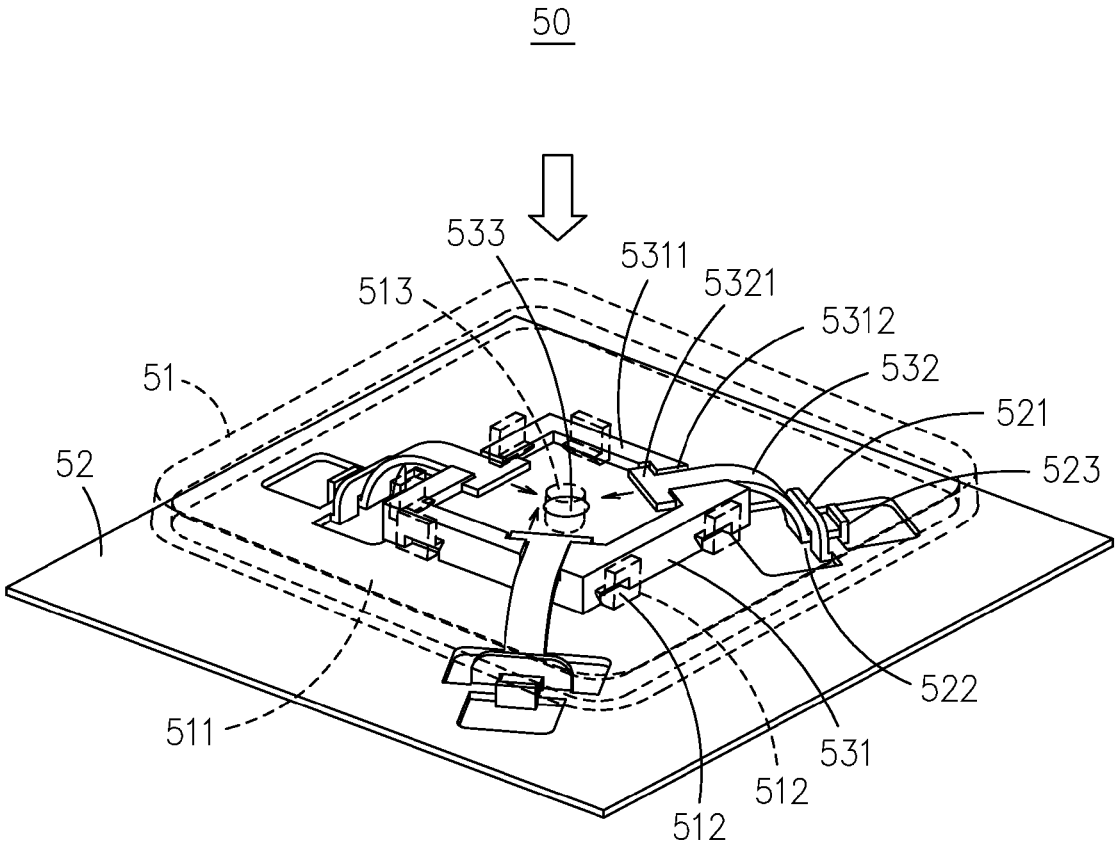
FIG. 10 is a three-dimensional view of a press-key structure according to the fourth embodiment of the invention.

Please refer to FIG. 9 and FIG. 10, which show a press-key structure according to a fourth embodiment of the invention. Similarly, the press-key structure 50 comprises a keycap 51, a substrate 52, and a pressing part 53. Comparing with the one shown in FIG. 3, the press-key structure in the fourth embodiment is characterized in that: the frame 531 of the pressing part 53 and the three supporting legs 532 are formed separately; and there is an upward-bulging flange 5311 being formed on the top circumference of the frame 531 in a manner that it is configured with a plurality of recesses 5312 at positions corresponding to the three supporting legs 532 to be provided for the corresponding supporting legs 532 to fit therein; and there is a plurality of stoppers 5321, each being formed on the end of its corresponding supporting leg 532 facing toward the frame and each being configured with a width larger than that of its corresponding supporting leg 532, each stopper 5321 being arranged to abut against the inner side of the flange 5311 when the supporting legs 532 are inset into their corresponding recesses 5312 on the top circumference of the frame 531. It is noted that there is no restriction relating to the shape of the frame 531, which can be formed as a disc, a rectangle or any geometrical shapes. In this embodiment, the frame 531 is shaped like a rectangle and the three supporting legs 532 are arranged equidistant from each other and surrounding the edges of the frame 531. Moreover, both the frame 531 and the supporting legs 532 can be made of a metal, a plastic or the combination thereof. In this embodiment, the frame 531 can be formed by plastic injection molding, while the supporting legs 532 can be formed by metal stamping.

Similarly, the keycap is configured with a bottom surface 511 while arranging the substrate 52 under the keycap 51, in which there are a plurality of hooks 512 being formed on the bottom surface 511 of the keycap 51, and thus the pressing part 53 and the keycap 51 can be connected with each other by enabling the hooks 512 to hold on to the edges of the frame 531. depending on the thickness of the frame 531, it is preferred to configure recesses 5313 on the bottom of the frame 532 at positions corresponding to the hooks 512 which is provided for the hooks 512 to hold on to. Moreover, the press-key structure 50 also has an orientation member, comprising: a column 513, formed on the bottom surface 511 of the keycap 51; and a hole 533, formed on the frame 531, provided for the column 513 to inset and pass therethrough. It is noted that such orientation member is not limited by the column 513 and the hole 533, it can be composed of other kinds protruding element and concave element, and moreover, it is also not to be limited by only one pair of such protruding element and concave element, as the one shown in FIG. 9.

In addition, there are a plurality of clipping parts 521 being arranged on the substrate 52 at positions corresponding to the outward-extending ends of the plural supporting legs 532, provided for the plural supporting legs 532 to engage therewith so as to form connections between the substrate 52 and the pressing part 53. In this embodiment, each clipping part 521 is configured with a hollow portion 522, which is provided for its corresponding supporting leg 532 to inset therein. It is emphasized that as the each supporting leg 532 in this embodiment is connected to the frame 531 by insetting its corresponding stopper 5321 into the recess 5312 formed on the flange 5311 of the frame and abutting against the inner side of the flange 5311, it is required that there should be blocking plates 523 to be arranged at positions respectively corresponding to the hollow portions 522 of each and every clipping part 521, which are provided for blocking the outward-extending ends of the plural supporting legs 532 from moving. As shown in FIG. 10, when the keycap 51 is being pressed, each stopper 5321 formed on the top end of its corresponding supporting leg 532 will be forced to move toward the column 513 since the outward-extruding end of every supporting leg 532 is blocked by the blocking plate 523 and the stopped 5321 is sandwiched between the frame 531 and the bottom surface 511 of the keycap; and then, as soon as the pressing force is removed, the resilience of the supporting legs 532 will prop up the frame 531 for raise the keycap 51 back to its corresponding original height.

Figure 11:
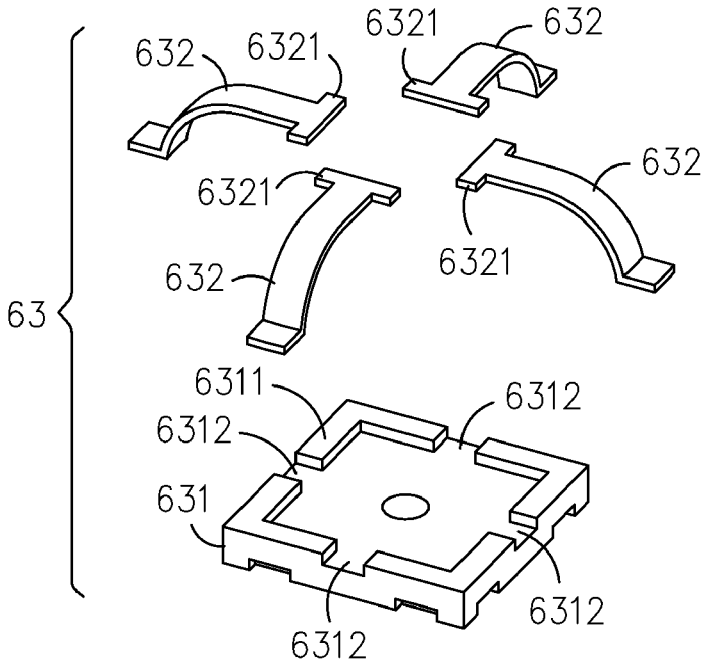
FIG. 11 is an explode diagram showing a first variation of the press-key structure disclosed in the fourth embodiment.
Figure 12:
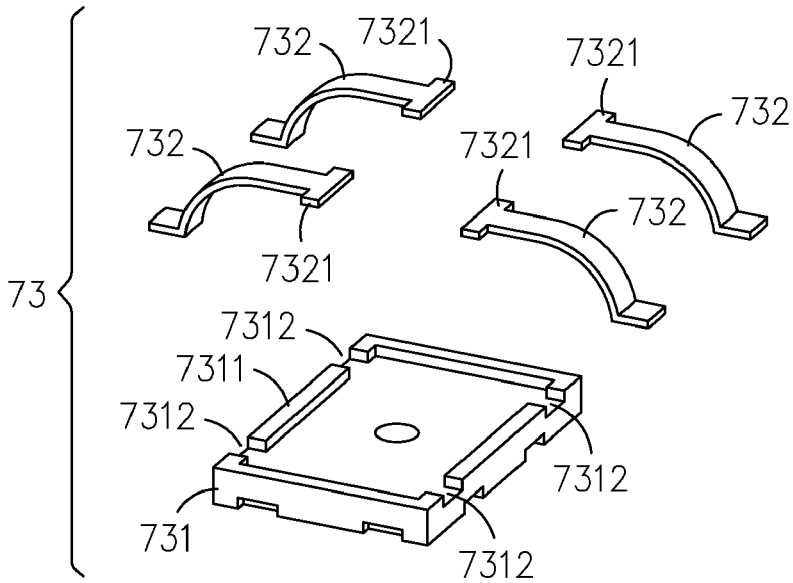
FIG. 12 is an explode diagram showing a second variation of the press-key structure disclosed in the fourth embodiment.

Please refer to FIG. 11 and FIG. 12, which show two different variations of the press-key structure disclosed in the fourth embodiment. In FIG. 11, the pressing part 63 comprises a frame 631 and four supporting legs 632, in which there is an upward-bulging flange 6311 being formed on the top circumference of the frame 631 in a manner that it is configured with a plurality of recesses 6312 at positions corresponding to the four supporting legs 632 to be provided for the corresponding supporting legs 632 to fit therein; and there is a plurality of stoppers 6321, each being formed on the end of its corresponding supporting leg 632 facing toward the frame 631 and each being configured with a width larger than that of its corresponding supporting leg 632, each stopper 6321 being arranged to abut against the inner side of the flange 6311 when the supporting legs 632 are inset into their corresponding recesses 6312 on the top circumference of the frame 631. The characteristic of the variation shown in FIG. 11 is that: the four supporting legs 632 are arranged equidistant from each other and surrounding the four sides of the rectangle-shaped frame 631. In FIG. 12, the pressing part 73 also comprises a frame 731 and four supporting legs 732. However, it is characterized in that: the recesses 7312 formed on the flange of the frame 731 are disposed at two opposite sides of the frame 731 in a symmetrical manner, by that the four supporting legs 732 are disposed at two opposite sides of the frame 731 in the symmetrical manner.

To sum up, the present invention provides a press-key structure, which is designed with a keycap capable of being assembled directly in a vertical stacking manner, by that not only the height of the keycap is reduced and the overall structure complexity of the press-key is decreased, but also such press-key structure can be assembled in a semi-automation manner with comparatively highly production efficiency and low defect rate. In addition, the size of the pressing part as well as the amount thereof can be varied and determined according to the size of the corresponding keycap, which can be adapted for various applications.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A press-key structure, comprising:

a keycap, configured with a bottom surface;

a substrate, being disposed under the keycap; and a pressing part, being arranged between the keycap and the substrate, further comprising:

a frame, disposed on the bottom surface of the keycap to be used for directly sustaining a pressing force from the keycap; and plural supporting legs, each being connected to the circumference of the frame by an end thereof while extending outwardly from the same; and thus connecting the outward-extending ends of the plural supporting legs to the substrate for supporting and propping up the frame by a specific height;

wherein the frame and the plural supporting legs are formed separately while forming coupling members at positions between the frame and the plural supporting legs to be used for connecting the substrate with the plural supporting legs, and each coupling member comprises:

an upward-bulging flange, formed on the top circumference of the frame in a manner that it is configured with a plurality of recesses at positions corresponding to the plural supporting legs to be provided for the corresponding supporting legs to fit therein; and a plurality of stoppers, each being formed on the end of its corresponding supporting leg facing toward the frame and each being configured with a width larger than that of its corresponding supporting leg, each stopper being arranged to abut against the inner side of the flange when the supporting legs are inset into their corresponding recesses on the top circumference of the frame.

2. The press-key structure of claim 1, wherein the frame is shaped into a shape selected from the group consisting a disc, a rectangle, and any geometry shapes.

3. The press-key structure of claim 1, wherein the plural supporting legs are arranged equidistant from each other and surrounding the edges of the frame.

4. The press-key structure of claim 1, wherein the plural supporting legs are disposed at two opposite sides of the frame in a symmetrical manner.

5. The press-key structure of claim 1, wherein there are a plurality of clipping parts being arranged on the substrate at positions corresponding to the outward-extending ends of the plural supporting legs, provided for the plural supporting legs to engage therewith so as to form connections between the substrate and the plural supporting legs.

6. The press-key structure of claim 5, wherein each clipping part is configured with a hollow portion provided for its corresponding supporting leg to inset therein.

7. The press-key structure of claim 5, wherein there are a plurality of blocking plates being disposed on the substrate at positions corresponding to the hollow portions of the plural clipping parts, provided for blocking the outward-extending ends of the plural supporting legs from moving.

8. The press-key structure of claim 1, wherein the frame is made of a material selected from the group consisting a metal, a plastic and the combination thereof.

9. The press-key structure of claim 1, wherein each of the plural supporting legs is made of a material selected from the group consisting a metal, a plastic and the combination thereof.

10. The press-key structure of claim 1, wherein there is a coupling member formed between the pressing part and the keycap to be used for connecting the two.

11. The press-key structure of claim 10, wherein the coupling member is composed of at least a hook and at least a hook catch.

12. The press-key structure of claim 11, wherein there is more than one such hook being disposed on the bottom surface of the keycap, while there is more than one such hook catches being disposed at positions corresponding to the hooks on the frame of the pressing part.

13. The press-key structure of claim 1, wherein there is an orientation member formed between the pressing part and the keycap, and the orientation member is comprised of: at least a protruding element; and at least a concave element, provided for the at least one protruding element to inset therein.

14. The press-key structure of claim 13, wherein the at least one protruding element is disposed on the bottom surface of the keycap while arranging the at least one concave element to be disposed at a position corresponding to the at least one protruding element on the frame of the pressing part.

15. The press-key structure of claim 14, wherein the at least one protruding element is disposed on the bottom surface of the keycap at the center thereof while arranging the at least one concave element to be disposed at a position corresponding to the at least one protruding element at the center of the frame.

16. The press-key structure of claim 14, wherein the concave element can be formed as a hole or a recess.

17. The press-key structure of claim 13, wherein the protruding element is a column while the concave element is round-shaped recess for the column to be embedded therein.

* * * * *